US008146497B2

(12) United States Patent
Caliari

(10) Patent No.: US 8,146,497 B2
(45) Date of Patent: Apr. 3, 2012

(54) METHOD AND MACHINE FOR ALIGNING FLEXOGRAPHIC PRINTING PLATES ON PRINTING CYLINDERS

(75) Inventor: Franco Caliari, Brescia (IT)

(73) Assignee: SYS TEC S.r.l., Brescia (IT)

( * ) Notice: Subject to any disclaimer, the term of this patent is extended or adjusted under 35 U.S.C. 154(b) by 717 days.

(21) Appl. No.: 11/568,656

(22) PCT Filed: May 4, 2004

(86) PCT No.: PCT/IT2004/000244

§ 371 (c)(1),
(2), (4) Date: Nov. 24, 2006

(87) PCT Pub. No.: WO2005/105449

PCT Pub. Date: Nov. 10, 2005

(65) Prior Publication Data

US 2007/0272103 A1 Nov. 29, 2007

(51) Int. Cl.
*B41F 1/34* (2006.01)
*B41F 3/02* (2006.01)

(52) U.S. Cl. ..... 101/485; 101/486; 101/477; 101/480; 101/481

(58) Field of Classification Search ..... 101/248, 101/486, 485, 382.1, 415.1, 477, 480, 481; 348/207.99
See application file for complete search history.

(56) References Cited

U.S. PATENT DOCUMENTS

| | | | | |
|---|---|---|---|---|
| 3,903,363 | A * | 9/1975 | Montone et al. | 348/87 |
| 4,309,496 | A * | 1/1982 | Miller | 430/30 |
| 4,380,956 | A * | 4/1983 | Elworthy | 101/401.1 |
| 4,520,389 | A | 5/1985 | Hornschuh | |
| 5,132,911 | A * | 7/1992 | Leader et al. | 700/114 |
| 5,542,002 | A | 7/1996 | McMasters et al. | |
| 5,633,676 | A * | 5/1997 | Harley et al. | 348/95 |
| 5,850,789 | A * | 12/1998 | Rudolf et al. | 101/486 |
| 6,166,744 | A * | 12/2000 | Jaszlics et al. | 345/629 |
| 6,207,946 | B1 * | 3/2001 | Jusoh et al. | 250/208.1 |
| 6,252,632 | B1 * | 6/2001 | Cavallaro | 348/585 |
| 6,646,686 | B1 * | 11/2003 | Gryskiewicz et al. | 348/584 |
| 6,750,913 | B1 * | 6/2004 | Noro et al. | 348/333.02 |
| 6,909,377 | B2 * | 6/2005 | Eberl | 340/815.4 |
| 7,024,054 | B2 * | 4/2006 | Cahill et al. | 382/294 |
| 2001/0034592 | A1 * | 10/2001 | Herman | 703/13 |
| 2002/0081014 | A1 * | 6/2002 | Ravkin | 382/134 |
| 2002/0196366 | A1 * | 12/2002 | Cahill, III | 348/537 |
| 2003/0020824 | A1 * | 1/2003 | Ito et al. | 348/345 |
| 2003/0043277 | A1 * | 3/2003 | Kamon | 348/207.99 |
| 2003/0103139 | A1 * | 6/2003 | Pretzer et al. | 348/143 |
| 2003/0128344 | A1 * | 7/2003 | Nishi | 355/52 |
| 2003/0202107 | A1 * | 10/2003 | Slattery | 348/207.99 |
| 2004/0075623 | A1 * | 4/2004 | Hartman | 345/1.3 |
| 2004/0113904 | A1 * | 6/2004 | Nakamura et al. | 345/204 |
| 2004/0218100 | A1 * | 11/2004 | Staker et al. | 348/592 |

FOREIGN PATENT DOCUMENTS

| | | |
|---|---|---|
| EP | 0329228 | 8/1989 |
| EP | 1477312 | 11/2004 |

* cited by examiner

*Primary Examiner* — Ren Yan
*Assistant Examiner* — David Banh
(74) *Attorney, Agent, or Firm* — Shoemaker and Mattare

(57) ABSTRACT

The present invention relates to a method for aligning at least two flexographic printing plates on at least one printing cylinder, which provides acquiring an image of a part of a first plate, memorising the acquired image, framing a part of a second plate, at the same time displaying the memorised image and the image relating to the part of the second framed plate in real time; and aligning the image framed in real time with the memorised image.

25 Claims, 12 Drawing Sheets

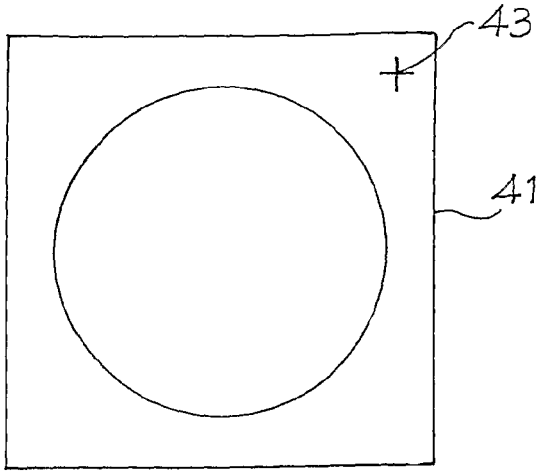
Fig.11
Fig.12
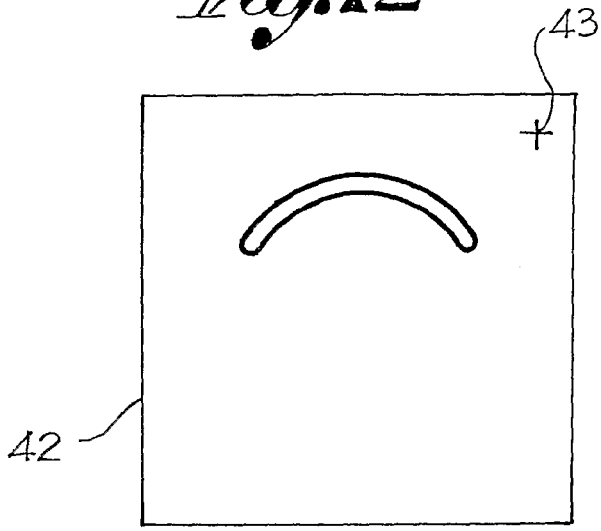
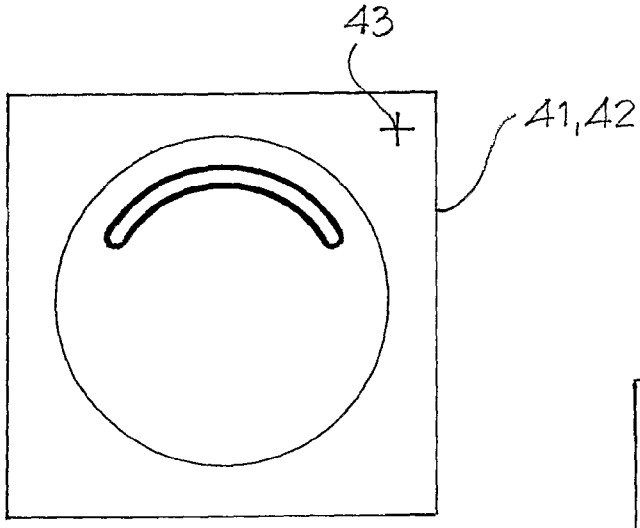
Fig.13
Fig.14
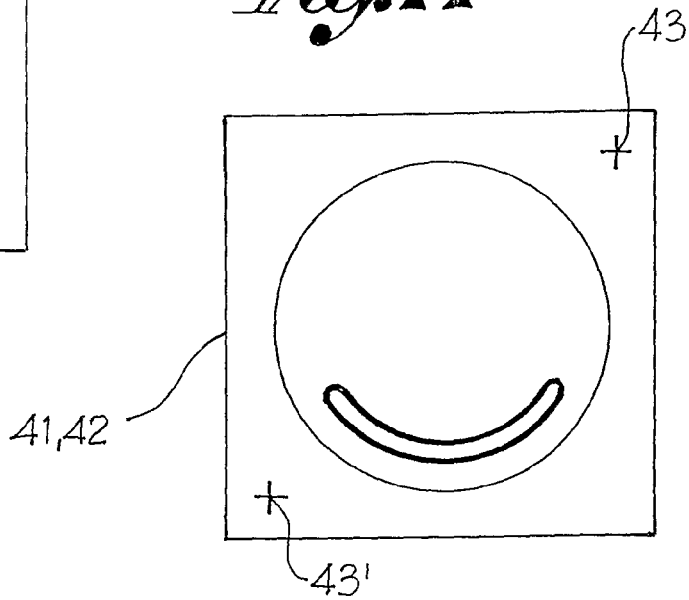

METHOD AND MACHINE FOR ALIGNING FLEXOGRAPHIC PRINTING PLATES ON PRINTING CYLINDERS

BACKGROUND OF THE INVENTION

A method and machine for aligning flexographic printing plates on printing cylinders are the subject of the present invention.

As is known, flexible plates or cliche are used in the printing sector for packaging, for example flexible packaging, PVC wrapping, paper bags, napkins, tablecloths and boxes for the paper and cardboard industry. On these flexible plates or cliche there are raised parts suitable for realising the design, or part of the design that needs to be printed.

In particular, if there is the need to print images with various colours, it is necessary to include a variety of plates, each with just the part of the design to be created in the relative colour raised. This plurality of plates is fixed individually on separate cylinders or printing sleeves to transfer the relative colour separately, which is deposited on the raised parts, to the strip, for example of paper, which runs or rolls on these rotating cylinders.

In order for the different plates to make up one single multi-coloured image, it is necessary for them to be well aligned or, in other words, for them to work on the same part of the strip or film of paper to be printed. To do this, they must be mounted on the relative printing cylinder in the same position.

One of the requirements for obtaining sharp images and avoiding errors of the various colours of one same image overlapping is therefore to make the positions of the different plates to be used to create this image on the relative printing cylinders coincide exactly. In other words, the position of the plates on the cylinders must always be the same.

In order for them to be aligned, the plates currently used usually present specific references at the ends, for example in the shape of small crosses, circles or squares, which must coincide with alignment systems planned on plate mounting machines. These alignment systems generally comprise light signal projectors, for example laser rays, microscopes, optical scanners, and telecameras.

For example, patent EP 0 329 228 describes a device for positioning a flexible printing plate with at least two position marks on one printing cylinder, comprising two light sources that are movable in a direction parallel to the axis of the printing cylinder to project two light signs on said printing cylinder, a memory for storing the coordinates of the position signs on the printing plates, and a control unit for controlling movement of the light sources in relation to the coordinates of the position marks present in the memory.

In practice, once the light sources have been suitably positioned according to the theoretic coordinates or coordinates required present in the memory for projecting corresponding light signs on a printing cylinder, an operator manually positions a plate on the cylinder so that the position marks on this coincide with the projected light signs.

U.S. Pat. No. 3,186,060 describes a device for mounting curved and rigid printing plates on printing cylinders. Alignment of the plates is carried out by positioning two lamps so that the signs projected by these coincide with two signs foreseen on a printing plate. The subsequent plates are positioned so that their reference signs coincide with the signs projected by the lamps.

U.S. Pat. No. 4,448,522 relates to a method and automatic control device for aligning printing cylinders of a printing machine. According to this method, an operator inserts the theoretic coordinates into a control computer, which should have the reference marks on the printing plates mounted on the cylinders. Two optical scanners are commanded to position themselves in said theoretic coordinates and carry out a "brush" along each printing plate until they intercept the relative reference marks. After measuring the error between the theoretic position and the real one, actuator devices connected to the cylinders are driven to correct the position of the cylinders until said error is eliminated.

The use of telecameras as devices for alignment is currently very popular thanks to their flexibility. It is in fact possible to create a virtual reference figure on the telecamera video of a desired form and then position the plates on the cylinder so that the reference marks, which are present on these, are framed by the telecameras and coincide with the figure of reference on the video.

All of the equipment and methods referred to above nonetheless require the presence of suitable reference marks on the plates and extremely high mechanical precision of this equipment. In particular, there must be perfect alignment between the axis on which the alignment instruments move, the axis of the printing cylinder and the axis passing through the reference marks of the plates.

SUMMARY OF THE INVENTION

The object of the present invention is to enable alignment of printing plates also without marks for reference, such as small crosses.

Another object of the invention is to carry out the operation of aligning the plates with very high levels of precision, but using a machine that is not necessarily precise from a mechanical point of view.

Said objects are achieved using an alignment method of flexographic printing plates on printing cylinders according to claim 1 and with a machine suitable for realising this method according to claim 24.

BRIEF DESCRIPTION OF THE DRAWINGS

The characteristics and advantages of the method and machine according to the present invention will nonetheless appear evident from the description reported below of preferred examples of embodiment, which are indicative and not limiting, with reference to the accompanying drawings, wherein:

FIGS. 11 and 12 show an example of two plates fitted with reference marks suitable for composing one single image to be printed and;

FIGS. 13 and 14 show the overlapping two plates of the previous figures, according to two different methods.

DESCRIPTION OF THE PREFERRED EMBODIMENTS

Figure 1:
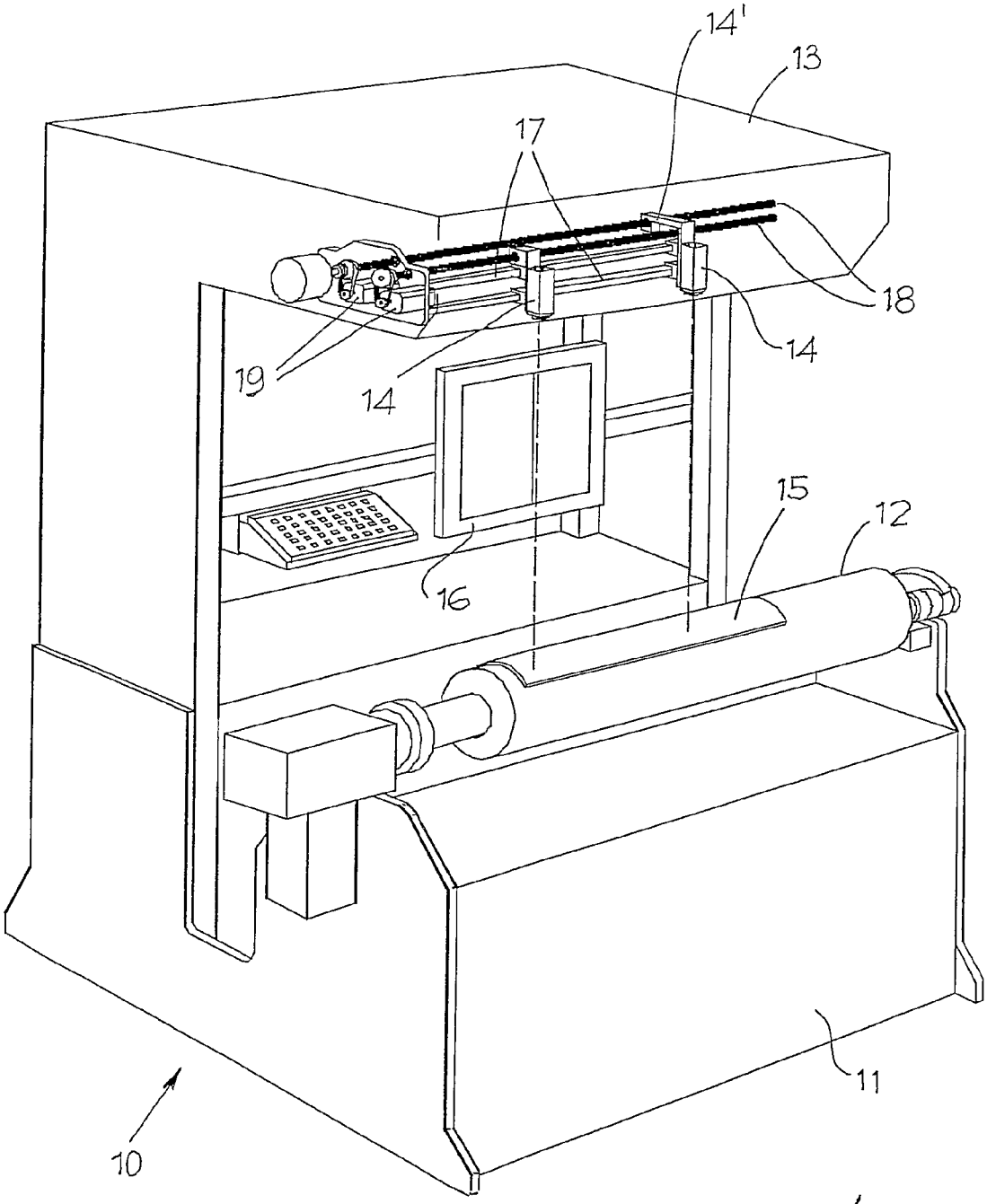
FIG. 1 shows a perspective view of the machine according to the invention.
Figure 2:
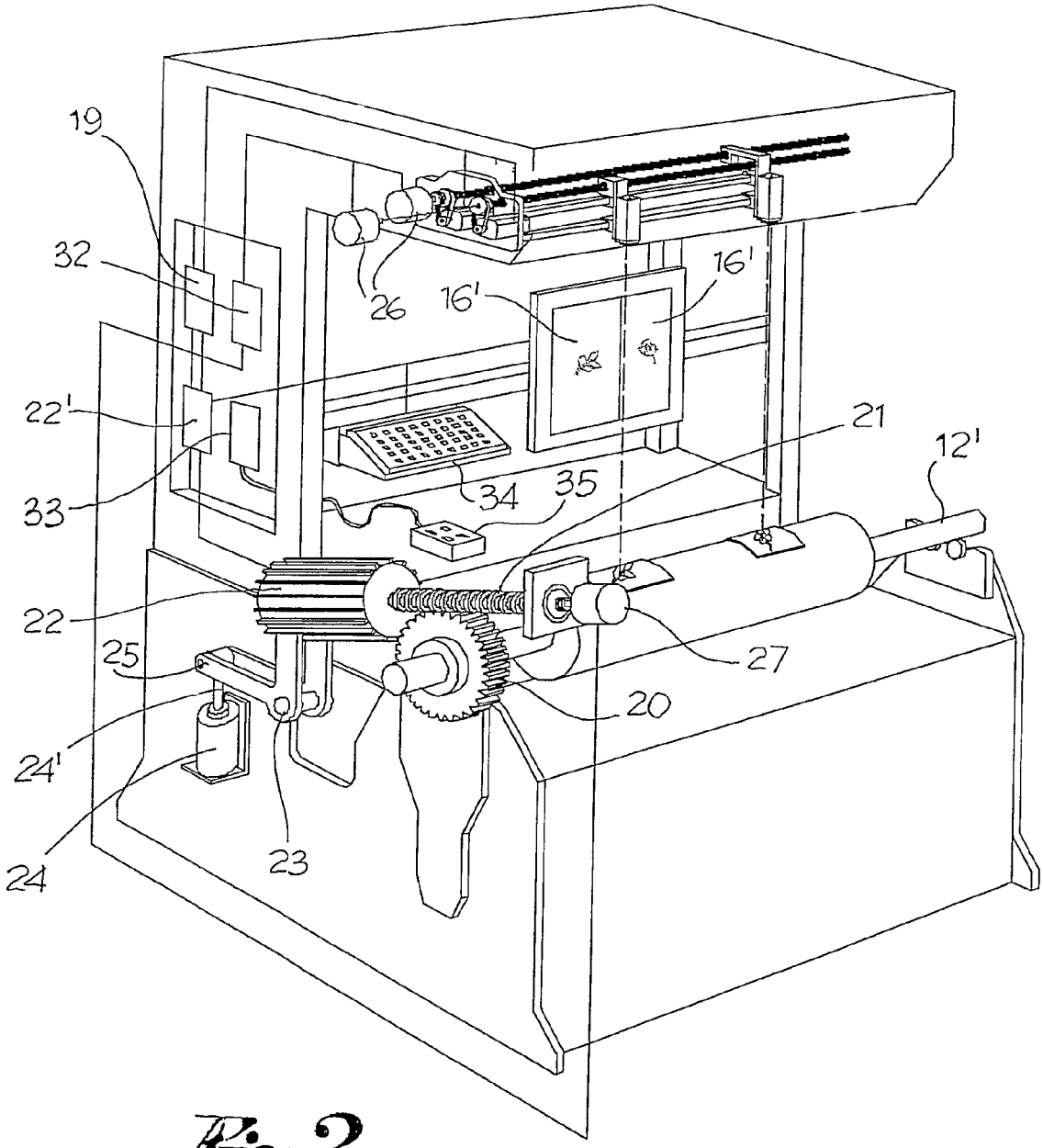
FIG. 2 shows the machine transparent to highlight its electrical and mechanical devices.

With reference to the figures, the machine for mounting flexographic plates on printing cylinders presents a structure 10 that basically comprises a bench 11 suitable for supporting a printing cylinder 12 in a rotating manner. A soleplate 13 extends at the back and above said cylinder and is suitable for supporting at least one device for acquiring images 14 that can be moved in a direction basically parallel to the axis of the printing cylinder to capture or frame a part of a printing plate 15 mounted on the cylinder 12. A display device 16 intended to display the images acquired by said acquisition device is connected to the image acquisition device.

By image acquisition device it has to be meant a transducer or sensor suitable for capturing or framing an object set within its field of vision and suitable for converting the image caught or framed into a flow of information of an electrical nature that is suitable to be sent to a display device, which can transform said information into signals suitable for reproducing the framed image visually and practically in real time.

In a preferred embodiment, the devices for acquiring the images 14 are made up of two telecameras. The telecameras 14 are fixed to relative trolleys 14' sliding on relative guides 17. Each trolley 14' is translatable by a relative endless screw 18, which is controlled by a relative motor 19 mounted on the soleplate 13.

The printing cylinder 12 is fitted with a shaft 12' on which a toothed wheel 20 is keyed, whose teeth engage in an endless screw 21 that is commanded to rotate by a motor 22. Endless screw 21 and motor 22 are subject to oscillate around a pin 23 that is integral with the structure of the machine to allow the screw 21 to be released from the toothed wheel 20 for removing the printing cylinder 12 from the bench 11. Said oscillation is given by a piston 24 on whose stem 24' an oscillating arm 25 is fixed, which is integral with the motor 22.

Advantageously, relative angular position sensors 26, 27, for example encoders, are linked to the driving motors 19 of the telecameras 14 and to the printing cylinder motor 22.

The telecameras 14, the display devices 16, the motors 19, 22 and the encoders 26, 27 are controlled by a processing unit 28, for example a personal computer. Said processing unit 28 is fitted with a monitor, which advantageously is suitable for realising the display devices 16. For example, display windows 16' can be created on said monitor, each connected to a corresponding telecamera 14.

Figure 3:
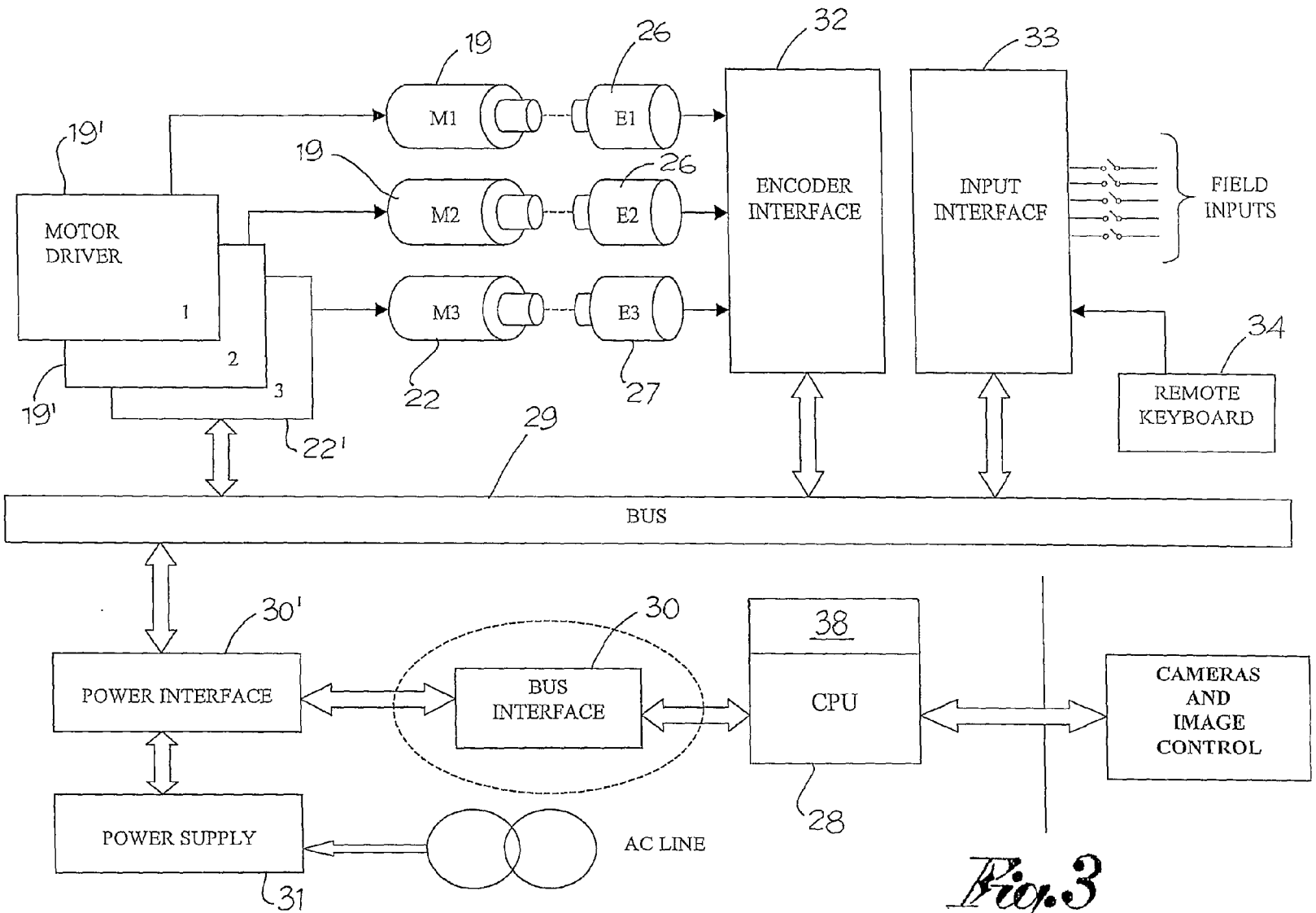
FIG. 3 shows a block diagram of the electrical circuits in the previous figure.

FIG. 3 shows an example of connection of the motors and relative encoders to the unit 28. The latter controls motors and encoders by means of a communication system 29, advantageously a data bus. The unit 28 communicates with the bus 29 by means of a logic 30 and power 30' interface, the latter being supplied electrically by a feeder 31 that is connected to the net voltage.

Electronic cards 19', 22' for driving motors 19, 22 are connected to the communication bus 29, as well as an electronic interface card 32 for encoders 26, 27 and an electronic interface card 33 for input signals to the processing unit 28, such as a keyboard or a push-button panel 34.

Figure 4:
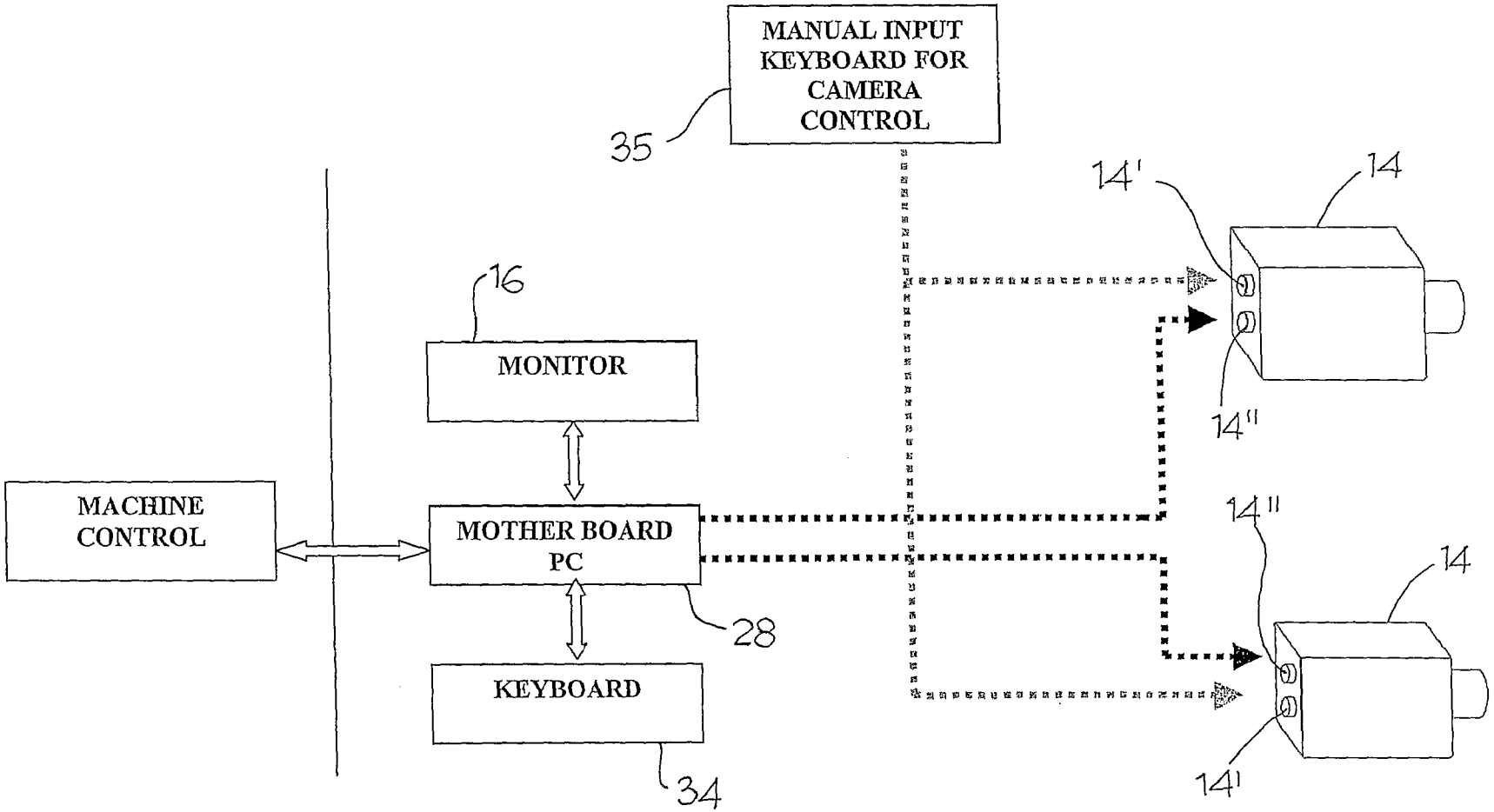
FIG. 4 shows a block diagram of the control devices of the telecameras with which the machine is fitted.
Figure 5:
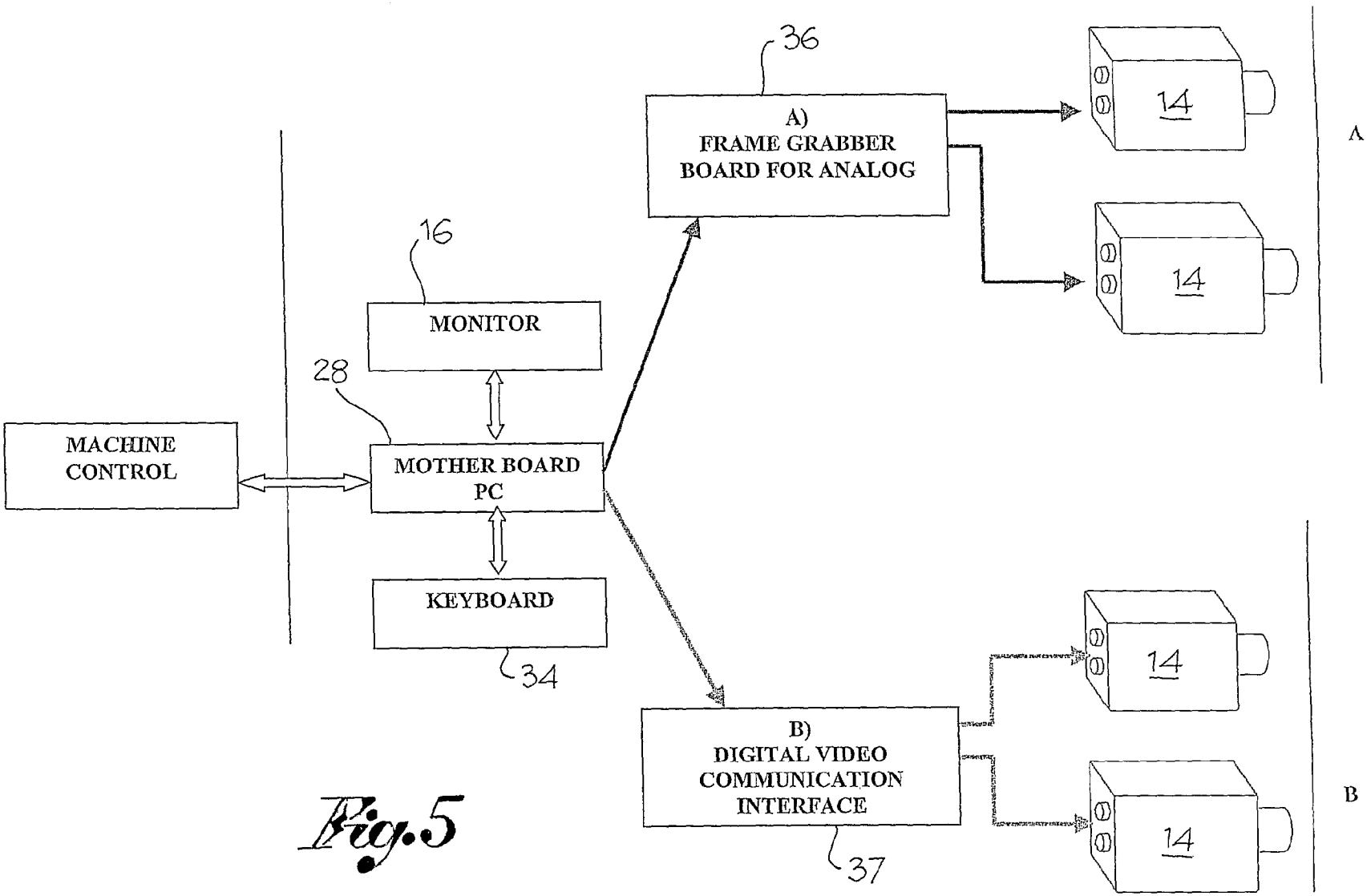
FIG. 5 shows a block diagram of the devices suitable for processing the images acquired by the telecamera.
Figure 6A:
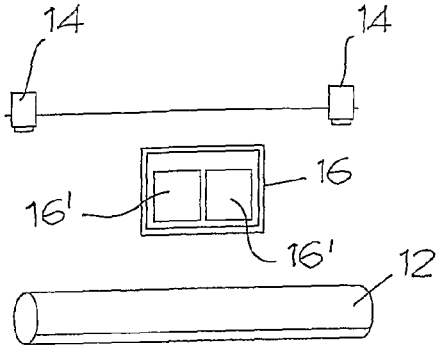
FIGS. 6*a*-6*f* schematically represent the mounting and alignment phases of two printing plates on relative cylinders.
Figure 6D:
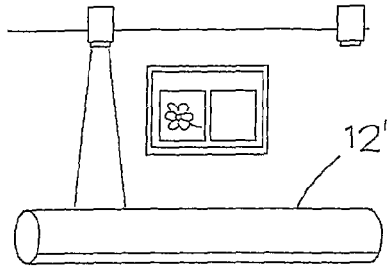
Figure 6B:
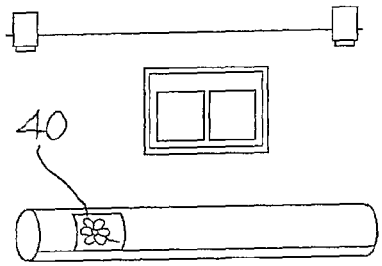
Figure 6E:
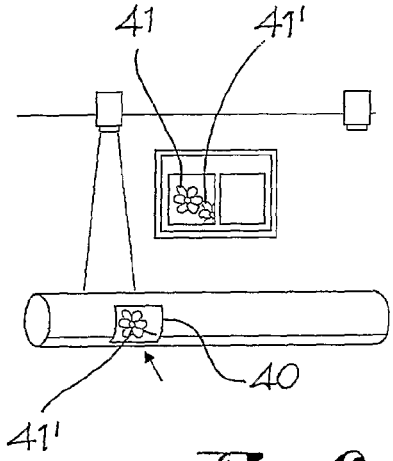
Figure 6C:
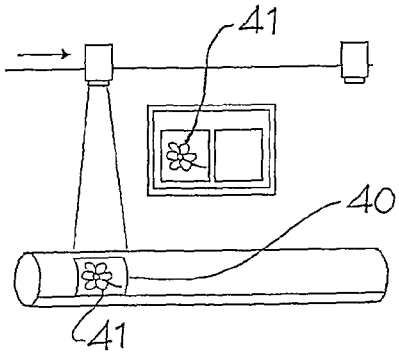
Figure 6F:
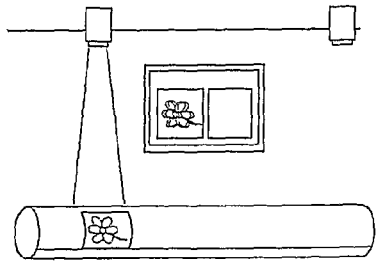
Figure 7A:
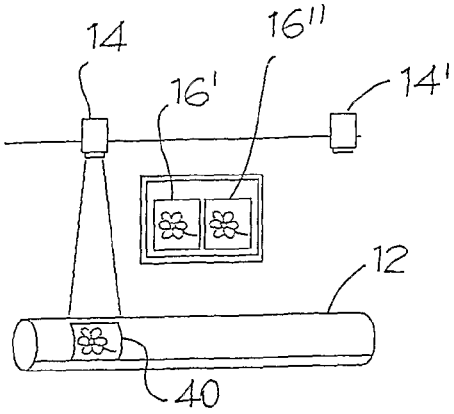
FIGS. 7*a*-7*d* schematically represent the mounting and alignment phases of two printing plates on one same cylinder and on the same directrix.
Figure 7B:
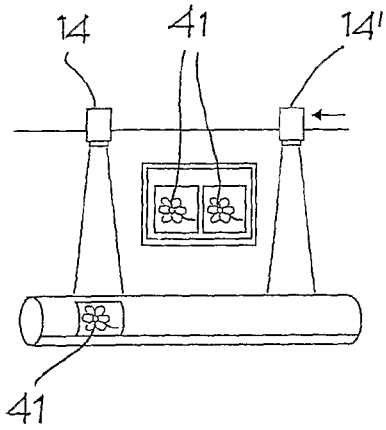
Figure 7C:
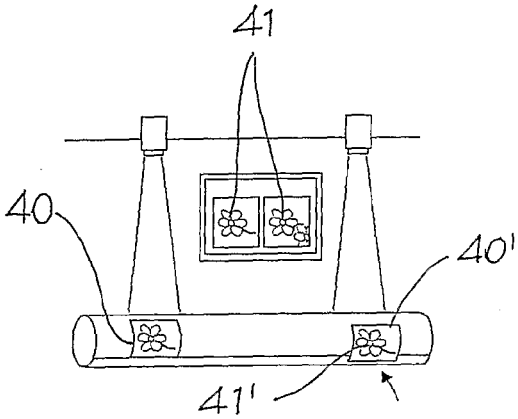
Figure 7D:
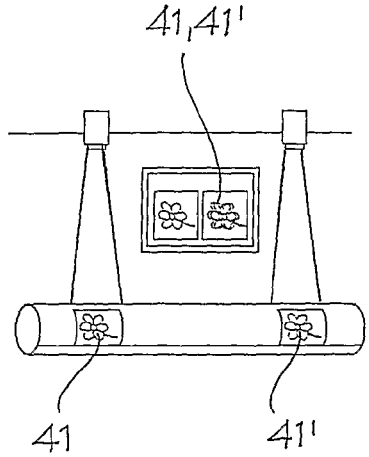
Figure 8A:
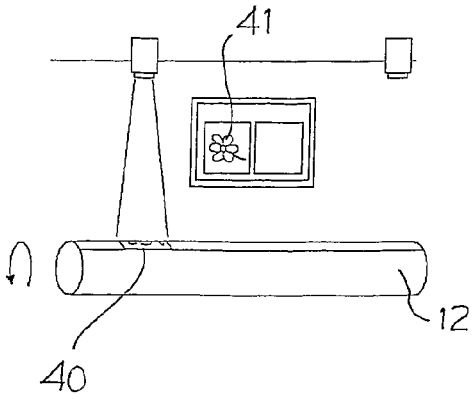
FIGS. 8*a*-8*e* schematically represent the mounting and alignment phases of two printing plates on one same cylinder in different angular positions.
Figure 8B:
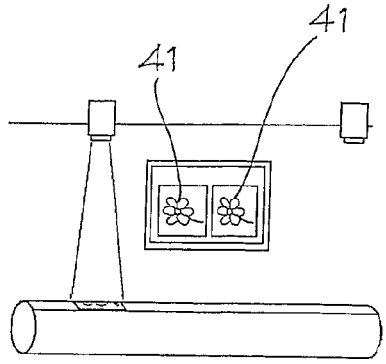
Figure 8C:
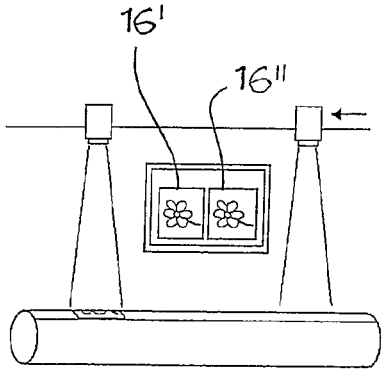
Figure 8D:
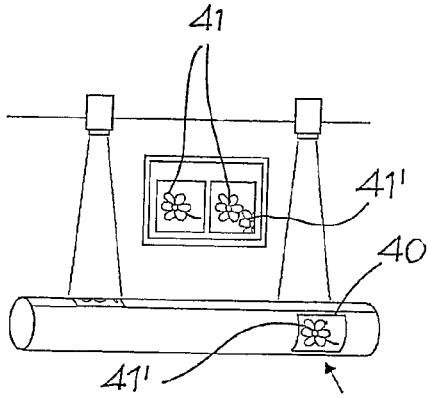
Figure 8E:
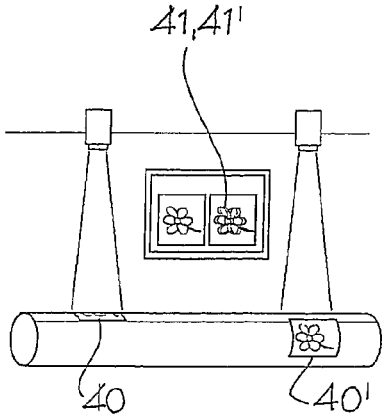
Figure 9:
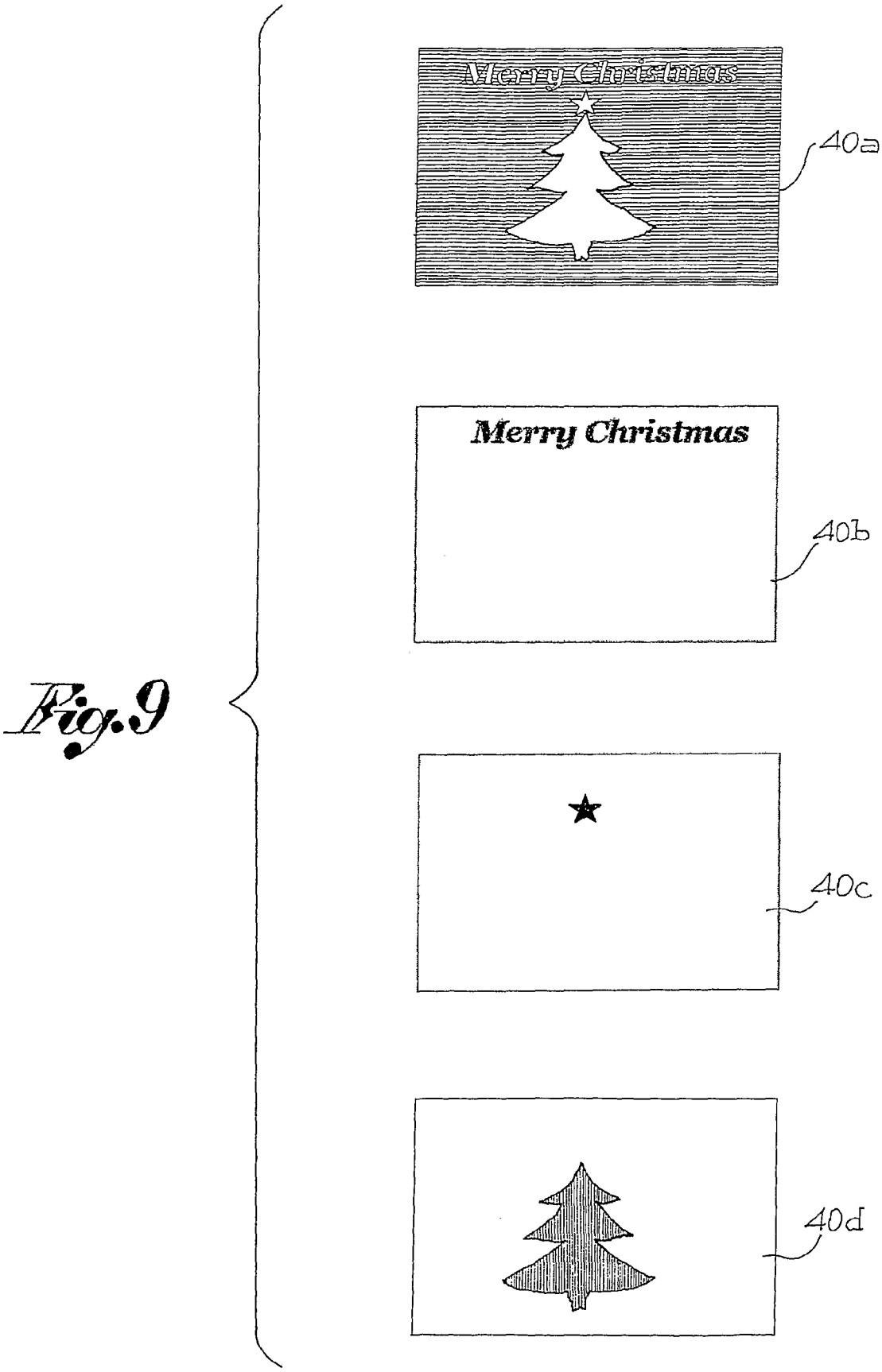
FIG. 9 shows an example of a set of four printing plates suitable for making one single graphical motif composed of four colours.
Figure 10A:
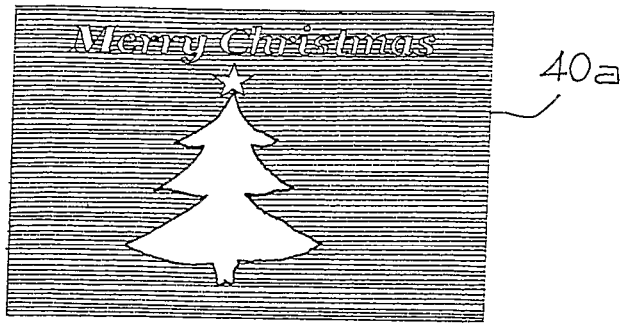
FIGS. 10*a*, 10*b* and 10*c* represent the assembly of the plates in the previous figures realised with the method according to the present invention.
Figure 10B:
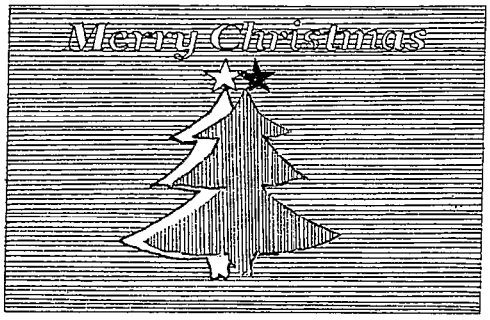
Figure 10C:
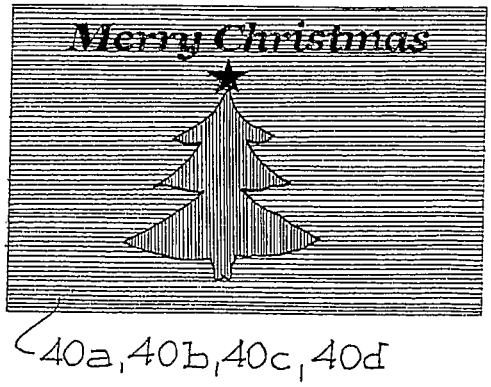

As represented in FIG. 4, each telecamera 14 is fitted with two input connectors 14', 14". One connector 14' is connected to a specific push-button panel 35 for manual control of the telecameras; the other connector 14" is connected to the processing unit 28 to control the telecameras by means of a suitable communication protocol.

Each telecamera 14 is also fitted with devices for setting and adjusting the optical, mechanical and electronic parameters that characterise acquisition and processing of the images. These devices comprise an electronic interface that can be analogical type (36), called "frame grabber card", or digital type (37). In both cases, the interface is controlled by the processing unit 28.

By optical or mechanical parameters of the telecamera, it has to be intended typically the zoom factor and focus. By electronic parameters, it has to be meant in particular the digital zoom, the colour gain index, the colour contrast value, the colour saturation value, the colour shading, and the luminosity value of the image.

Other devices suitable for influencing the atmosphere surrounding the image acquisition devices can also be part of the machine. For example, artificial lighting systems and optical lens filtering systems can be included. Advantageously, these devices can also be connected and controlled by the processing unit 28, which can then acquire and set its parameters in remote mode.

According to the invention, memorisation devices adapted to storing the information of an electrical nature relating to the acquired images are connected to the telecameras 14, in other words, all of the information both digital and analogical, which defines the information constituting the visual representation of an image caught by the telecamera. In the preferred example of embodiment described here, the memorisation devices comprise permanent memories 38 controlled by the processing unit 28.

The display window 16' can then display both an image framed in real time by a telecamera and a previously acquired and memorised image.

In particular, and according to the invention, a previously acquired, memorised image acting as a background and an image relating to a part of a plate caught in real time can be displayed at the same time on a display window 16'. In other words, the memorisation devices allow at least two images to be overlapped. Since an image caught by the telecamera is made up of infinite points, alignment of the second and subsequent plates with the first is thus achieved by aligning the second or successive images with the first.

In practice, each plate has raised parts for creating corresponding parts of the graphical motif to be printed with one same single colour. Therefore, two or more overlapping images are generally understood to be aligned, when the corresponding raised parts displayed at the same time are perfectly drawn together so they are complementary.

Unusually, the method according to the present invention allows a complementary association of details or image parts to be created, which make up the image to be printed as a whole, when they are suitably drawn together. In this way, the operation of aligning two or more plates is particularly simple to carry out and free of any constraints of mechanical precision of the machine or connected to marks of reference on the plates. The operation of alignment can thus be repeated with the same level of precision, regardless of the mechanical characteristics of the machine or plates used.

In the particular case of two identical plates, overlapping and alignment of the relative images would also result in the raised parts overlapping exactly.

Also advantageously, the memorisation devices can be connected to several telecameras and relative display devices so that an image acquired by a telecamera can be memorised and displayed on the display device connected to another telecamera.

With reference to FIGS. 6*a*-6*f*, the method that allows printing plates to be aligned on relative cylinders according to the present invention provides that a first flexographic plate 40 is mounted, in any position, on a relative cylinder 12 and that a telecamera 14 is brought into a position to be able to frame an image 41 consisting of part of said plate 40. Said image 41 is acquired, memorised and displayed as the background on a display window 16'. At this point, it is possible to remove the first cylinder 12 from the machine and mount a second one 12'. Then, the operator puts a second plate 40' on this second cylinder 12', positioning it in such a way that the image 41', which is framed by the telecamera and displayed in real time on the window 16' of the monitor 16 is aligned with the 41 previously acquired image loaded onto the background. Perfect alignment of the two plates corresponds to this situation of alignment of the two overlapping images.

The same procedure can be carried out for other subsequent printing cylinders. All of the plates will be aligned with the first, whatever its position on the first printing cylinder.

According to the present invention, the machine also allows several plates 40, 40' to be aligned on one same printing cylinder 12.

For example, the method described in FIGS. 7*a*-7*d* allows two plates to be mounted on different printing bands of one same cylinder, aligning them at the same longitudinal height, or directrix, the so-called "track". The method provides to mount a first plate 40 on a printing cylinder 12 in a position, which the operator considers to be most convenient. The image acquired by a telecamera 14 and displayed on a relative window 16' of the monitor 16 is memorised and loaded onto a second window 16" that is connected to a relative second telecamera 14'. At this point, the operator brings said second telecamera 14' into a position that he considers to be more suitable for mounting the second plate 40'. Then, the operator can proceed with mounting the second plate 40' aligning the image detected in real time by the second telecamera 14' and displayed on the second window 16" with the one loaded as the background on said second window.

Instead, in the example shown in FIGS. 8*a*-8*e*, the method provides to mount two plates 40, 40' on two different printing bands of one same cylinder, aligning them at a different angular position. The method differs from the one previously described, in that the printing cylinder 12 is rotated in the required position between the mounting of the first and the second plate.

It will be noted that the procedure, which provides transferring an image acquired by a telecamera to the display device connected to another telecamera, can also be extended to when the second or additional telecameras and relative display devices are mounted on another machine. This situation occurs, for example, when two or more plate mounting machines must supply the same job for two or more printing machines, also in different plants.

It must be pointed out that according to the present invention the machine also allows flexographic plates to be aligned without specific references, such as the traditional small crosses, since alignment is carried out by means of overlapping images, which are part of the graphic motif to be printed.

Advantageously, however, in order to facilitate the operation of aligning the images on the display window, the processing unit 28 is fitted with devices adapted to creating a figure of reference that can be displayed by the image display device 16. Also advantageously, this figure of reference can be moved, both linearly and by rotation by the operator using the processing unit keyboard so it adapts to the image acquired by the first plate. In this way, if this first plate were not aligned with the figure of reference due to an operator error, after being fixed to the printing cylinder, it is not necessary to move the plate, but simply align the figure of reference with the displayed image, even if it is wrong. In other words, this avoids unfixing the plate from the cylinder and/or causing stretching of the plate, which creates errors in other parts.

According to a further feature of the invention, the optical, mechanical and/or electronic parameters of the telecameras and/or the environmental parameters can be memorised by memorisation devices, such as for example the permanent memories 38 controlled by the processing unit 28. In this way, subsequent image acquisitions can be made in the same way for correct overlapping of the displayed images.

This characteristic is particularly advantageous when the operator frequently needs to vary one or more parameters of the telecamera. For example, it would no longer be possible to align two or more displayed images by changing the enlargement factor of the telecamera from one acquisition to another, which need is dictated by the fact that it is required to frame the part on which the complementary association of details composing the image is to be made. Whereas, by connecting the parameters to an image used for its acquisition, it is possible to make a subsequent acquisition using the same operative characteristics simply by recalling said parameters, even if the configuration of the telecamera between the two acquisitions had been varied.

In particular, it is extremely convenient to memorise the position in which a telecamera has acquired an image and then associate the electronic, mechanical, optical parameters of the telecamera and/or the environmental parameters to said position. In this way, even in the case of the telecamera moving between a first and second acquisition of images of plates for one same job, it is possible to bring the telecamera back to the exact same position and configuration as the first acquisition. For example, during the first acquisition of an image relating to a motif to be printed, it is particularly advantageous to save said image with a name of reference to which the position of the telecamera, the parameters with which the acquisition was made, and optionally, the angular position of the printing cylinder are associated. Then, during a successive acquisition for the same job, it is enough to recall the name of reference to have and set the correct parameters and position of the telecamera and, optionally the printing cylinder.

According to an example of embodiment described here, the machine for mounting and aligning the printing plates is equipped with a feedback control system, or closed ring, for the telecameras and the printing cylinder, which allows the relative motors to be driven so as to bring telecameras and printing cylinder automatically into a memorised position simply by recalling the reference of an image.

Alternatively, the telecameras and printing cylinder can be moved in an open ring, or manually by means of a hand-wheel or similar control part, or by means of motors. In this case, the display device 16 reports the difference between the current position of a telecamera and optionally of the printing cylinder and the memorised position; the operator checks the correct position of the telecameras and cylinder when this difference is reduced to zero.

According to a further aspect of the invention, some electronic parameters of the telecamera associated to acquisition of the images, such as for example the colour gain index, the colour contrast value, the colour saturation value, the colour shading value and the luminosity value of the image can be re-elaborated to suitable values to aid the overlapping and/or drawing together of the displayed images.

In addition to this, the processing unit 28 is advantageously provided with devices for processing the information of electric nature relating to the visual representation of an acquired image. These processing devices can, for example, allow a variation in the tonality of the colours, an adjustment of the transparency effect or fading of the images, or make combinations between two or more images, for example of "and" or "or" type.

Figure 15:
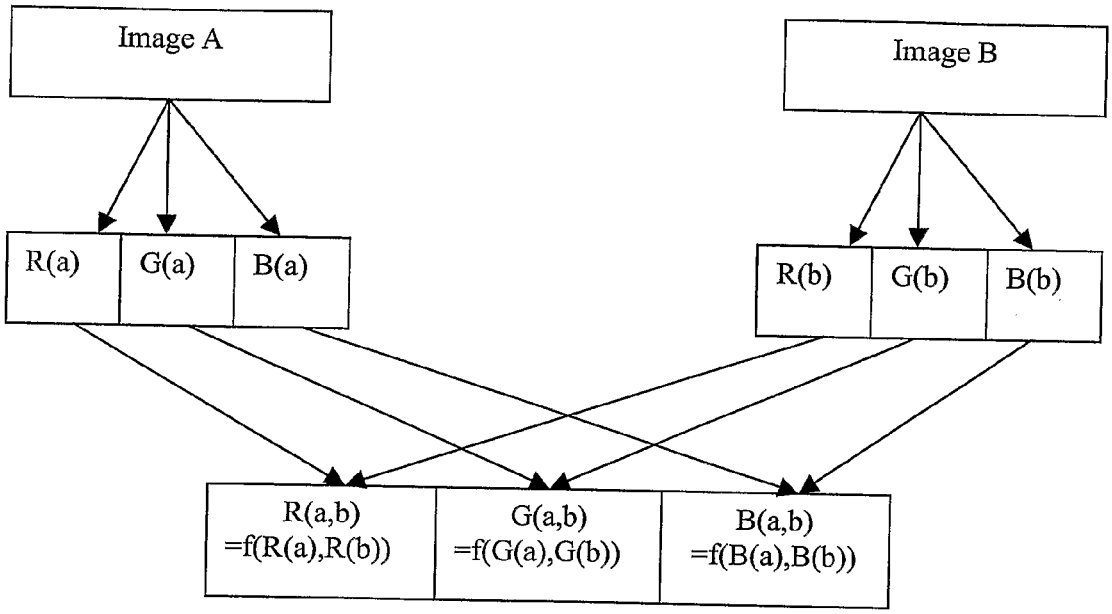
FIG. 15 schematically represents an algorithm for combining two images.

According to an example of embodiment, the transparency effect or image fading is obtained by algorithm software than can manage an image A from the device adapted to converting the images caught by a telecamera into digital information, at the same time as a previously memorised image B (FIG. 15).

The algorithm divides both images into the three basic chromatic components R (red), G (green) and B (blue). Then, the algorithm creates an image resulting from the combination, in variable percentages, of the chromatic components of the two images. The operator can select the mixing percentage of each chromatic component in real time by means of a user interface, with consequent immediate video variation of the resulting image.

Alternatively, it is possible to use non-uniform mixing functions to allow overlapping and transparency with percentage gradations that are not uniform to the whole work area, with the consequent possibility of applying the function only in limited areas.

To give an example, with reference to FIGS. 9 and 10*a*-10*c*, imagine arranging a set of four plates 40*a*, 40*b*, 40*c* and 40*d*, each relating to a colour.

The possibility of varying the colour tonality of the image acquired by the telecamera allows the contrast to be improved in the overlapping phase. The first plate to be mounted is the one relating to the background image, in this case 40*a*. This image is then loaded onto the background of the display window. The images relating to the successive plates simply need to be inserted into the relative spaces of the background image.

According to a form of embodiment, thanks to the possibility of varying the colour of the individual images, it is possible to simulate the ink that will be used. It is thus possible to check the effect of some or all of the overlapping at the same time, virtually simulating the printing test on paper.

It will be noted that if one plate is not correctly positioned, the relative image will be off register in relation to the background colour and the other colours.

The virtual simulation of the printing test on paper, which can be achieved by the above-described procedure, means it is possible to avoid the real printing test phase, which is a particularly complex operation that requires several hours' work by the operator. Moreover, the construction of the plate mounting machine is notably simplified, since the apparatus used for operating the printing test, such as the printing test drum, the mechanical members for connecting the printing cylinder to the drum, the electric members for driving the cylinder and the drum with the relative electronic control equipment are no longer necessary.

It must be pointed out that the method for aligning the present invention does not require overlapping between two identical objects, such as a small cross projected by a laser projector or displayed on the monitor of a telecamera and an identical small cross foreseen on the flexographic plates. The invention therefore allows plates to be used that do not need additional parts, such as the marks of reference that serve exclusively for their alignment, but which are not used for printing. This makes the operation of mounting the plates on the printing cylinders much more flexible and free of the dimensional tolerances of the mechanical devices of the machine.

To further clarify this advantage, it can be considered the example shown in the drawings from 11 to 14, where the final image to be printed is made up of a circle in whose upper part a figure is inserted. With the alignment methods used so far, plate 41 relating to the circle and plate 42 relating to the figure must have an element of reference 43 in one same position. This element of reference must be suitable for coinciding with the signals generated by the alignment devices mounted on the machine. If it were now necessary to insert the figure in the lower part of the circle (FIG. 14), instead of in the upper part, the reference mark that was used previously can no longer be used; it would be necessary to use one (43') in a diametrically opposite position to the centre of the circle. Therefore, originally the plates either have at least two reference marks 43, 43', or it is necessary to make special plates for the new image.

On the contrary, with the alignment method according to the present invention, the plates have no reference marks and can be aligned by drawing together the image parts intended to make up the image that is to be printed, whatever their position in relation to the printing cylinders.

What is claimed is:

1. A method for aligning at least two flexographic printing plates on respective printing cylinders, wherein each printing plate has raised parts for creating corresponding parts of a graphical motif to be printed with a particular color, said method comprising the steps of:

placing a first plate on a respective first cylinder and placing the first cylinder on a bench under at least one image acquisition device;

acquiring a first image of the raised part of the first plate by means of said at least one image acquisition device;

memorizing the first image;

memorizing at least one electronic, mechanical or optical parameter with which said first image was acquired;

memorizing the position of said at least one image acquisition device at which said first image was acquired;

associating a memorized parameter with said memorized position;

removing said first cylinder from said bench;

placing a second plate on a respective second cylinder and placing the second cylinder on the bench under said at least one image acquisition device;

positioning said at least one image acquisition device at said memorized position and configuring said image acquisition device to the memorized parameter;

contemporaneously displaying the memorized first image having the raised part of the first printing plate with a second image having the raised part of the second plate that is acquired in real time by the image acquisition device at the memorized position with the memorized parameter; and visually aligning the second image with the first image by moving the second plate on the second cylinder so that the image of the raised part of the second plate is drawn together with the image of the raised part of the first plate, thereby aligning the second plate with the first plate.

2. A method according to claim 1, wherein the second image framed in real time and the memorized first image are displayed overlapping each other.

3. A method according to claim 1, wherein said at least one electronic, mechanical or optical parameter is selected from the group consisting of zoom factor, focus, luminosity value, color gain index, color contrast value, color saturation value, and color shading value.

4. A method according to claim 1, further comprising a step of processing at least one of said images to aid alignment of said image with another image displayed at the same time.

5. A method according to claim 4, wherein said processing step comprises adjusting a transparency effect of at least one image.

6. A method according to claim 4, wherein said processing step comprises an "AND" or "OR" type logical combination of at least two images.

7. A method according to claim 4, wherein said processing step comprises varying color of at least one acquired image to improve the contrast when displayed at the same time with at least one other image.

8. A method according to claim 4, wherein said processing step includes displaying each image memorized with the color corresponding to the color of the ink, to obtain a simulation of what will actually be printed from the contemporaneous display of said images.

9. A machine for mounting and aligning at least two flexographic printing plates on respective printing cylinders, wherein each printing plate has raised parts for creating corresponding parts of a graphical motif to be printed with a particular color, said machine comprising:

a bench for sequentially mounting at least a first cylinder carrying a first printing plate, and a second cylinder carrying a second printing plate;

at least one image acquisition device for acquiring images of at least one first image of said first plate, the first image having a raised part of the first plate, when said first cylinder carrying said first plate is mounted on the bench;

an image memorizing device for memorizing the first image having the raised part of the first plate;

a position memorizing device for memorizing the position of said at least one image acquisition device at which said first image was acquired;

a parameter memorizing device for memorizing at least one electronic, mechanical or optical parameter with which said first image was acquired;

a control device for associating a memorized parameter with said memorized position such that the control device returns said at least one image acquisition device to said memorized position and configures said image acquisition device to the memorized parameter when the bench receives the second cylinder carrying the second plate;

a display device controlled by a display controller that retrieves the memorized first image having the raised part of the first printing plate from the image memorizing device and a second image-having the raised part of the second plate that is acquired in real time by the image acquisition device at the memorized position with the memorized parameter and causes the display device to contemporaneously display the retrieved images;

whereby the second plate is moved on the second cylinder to align the second image with the first image so that the image of the raised part of the second plate is drawn together with the image of the raised part of the first plate, thereby aligning the second plate with the first plate.

10. A machine according to claim 9, wherein said at least one image acquisition device is movable along a guide in a direction that is substantially parallel to the axis of the printing cylinder.

11. A machine according to claim 9, wherein said at least one optical parameter is selected from the group consisting of zoom factor, focus, luminosity value, color gain index, color contrast value, color saturation value, and color shading value.

12. A machine according to claim 9, further comprising devices for regulating environmental parameters influencing the operation of acquisition of the images, and devices for memorizing at least one of said parameters to allow subsequent image acquisitions to be made with the same value of at least one environmental parameter.

13. A machine according to claim 12, wherein said environmental parameters comprise an artificial lighting value produced by a lighting unit.

14. A machine according to claim 12, wherein said environmental parameters comprise a filtering value made by means of optical lenses.

15. A machine according to claim 9, further comprising a processing unit connected to the image acquisition device and to the image display device.

16. A machine according to claim 15, wherein said processing unit comprises image processing devices for acquiring and processing data relating to an image from said at least one image acquisition device.

17. A machine according to claim 16, wherein the image processing devices are suitable for allowing adjustment of the color tonality of the memorized image.

18. A machine according to claim 16, wherein the image processing devices are suitable for allowing adjustment of the fading effect of a memorized image.

19. A machine according to claim 16, wherein the image processing devices are suitable for allowing "AND" or "OR" type combinations of at least two memorized images.

20. A machine according to claim 15, wherein the processing unit is provided with devices adapted to create a figure of reference that can be displayed by at least one image display device to aid alignment of at least two images displayed at the same time.

21. A machine according to claim 20, wherein the processing unit is provided with devices adapted to move said figure of reference on the display device to adapt said figure to a displayed image.

22. A machine according to claim 9, further comprising first actuator devices for moving the at least one image acquisition device.

23. A machine according to claim 9, further comprising devices for memorizing an angular position of the printing cylinder.

24. A machine according to claim 23, further comprising second actuator devices for rotating the printing cylinder.

25. A machine according to claim 24, further comprising a processing unit suitable for comparing the value of the current position of the printing cylinder with a memorized angular position value, the printing cylinder being rotatable by the operator until the difference between said values is reduced to zero.

* * * * *